United States Patent [19]

Costabile

[11] Patent Number: 4,557,128

[45] Date of Patent: Dec. 10, 1985

[54] APPARATUS FOR PRODUCING A BULGE IN THIN METAL MATERIAL

[76] Inventor: John J. Costabile, 7037 E. Moreland, Scottsdale, Ariz. 85257

[21] Appl. No.: 725,306

[22] Filed: Apr. 19, 1985

Related U.S. Application Data

[62] Division of Ser. No. 343,280, Jan. 27, 1982, Pat. No. 4,513,598.

[51] Int. Cl.[4] ..... B26D 26/02

[52] U.S. Cl. ..... 72/62; 29/421 R; 72/58

[58] Field of Search ..... 72/58, 59, 60, 62; 29/421 R

[56] References Cited

U.S. PATENT DOCUMENTS

| | | | |
|---|---|---|---|
| 3,561,239 | 2/1971 | Tominay | 72/60 |
| 4,125,937 | 1/1972 | Brown | 72/62 |
| 4,173,136 | 4/1985 | Schroth | 72/62 |
| 4,319,471 | 3/1982 | Beulehe | 72/62 |
| 4,382,637 | 12/1982 | Whitfield | 72/62 |

*Primary Examiner*—Leon Gilden

*Attorney, Agent, or Firm*—Cahill, Sutton & Thomas

[57] ABSTRACT

A tube bulger for producing an enlarged ring-like bulge in the material around an end portion of a metal tube includes upper and lower die sections. When the upper and lower die sections are mated together, a cylindrical hole is formed. The end portion of the tube to be bulged extends into the hole. A ring-like, outwardly oriented enlargement of the cylindrical hole in the mated die sections forms a bulge cavity into which the bulge moves as it is being formed. An elongated mandrel extends through the opposite end of the cylindrical hole and into the open end of the tube. First and second sealing rings disposed about the mandrel on opposite sides of the bulge cavity prevent leakage of pressurized oil between the die and the mandrel. An oil conducting channel has an opening between the sealing rings. A high pressure oil source forces oil through the channel, out of the opening, thereby applying high pressure to the inner wall of the tube between the first and second sealing rings, causing an initial outward bulging of the tube into the bulge cavity. An enlarged shoulder of the mandrel abuts the open end of the tube, and is moved inward toward the recess, sliding the extreme end portion of the tube toward the bulge cavity. The partially formed bulge engages the wall of the bulge cavity, preventing sliding of the portion of the tube on the opposite side of the bulge cavity. Additional tube material then moves into the bulge cavity while the high pressure continues to be applied. Additional bulging occurs, causing enlargement of the bulge until it fills up the bulge cavity without excessive thinning of tube materials in the bulge.

8 Claims, 11 Drawing Figures

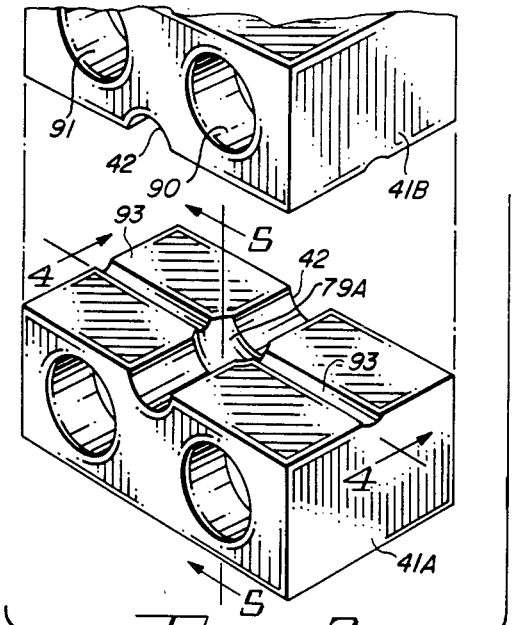
FIG. 3
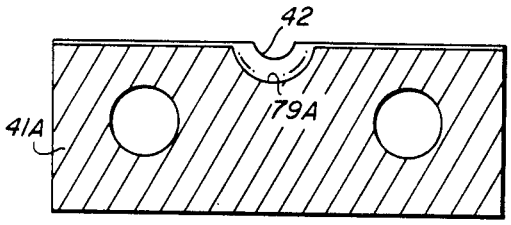
FIG. 4
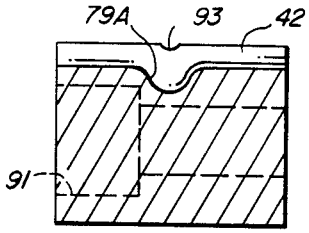
FIG. 5
FIG. 6
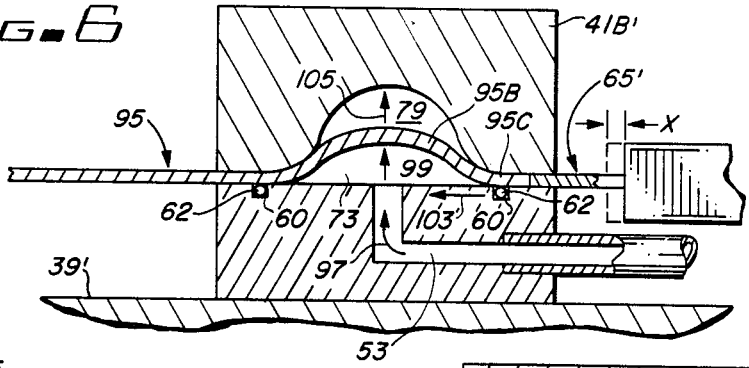
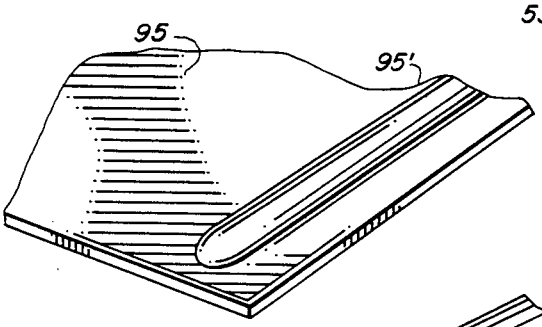
FIG. 7
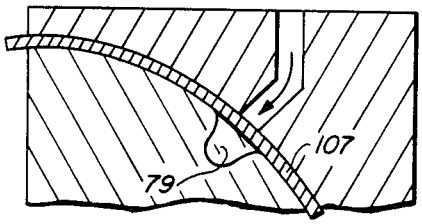
FIG. 8
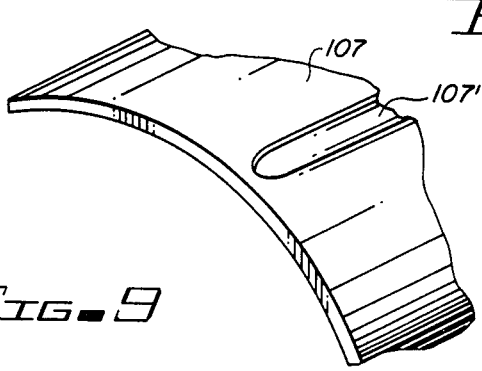
FIG. 9

APPARATUS FOR PRODUCING A BULGE IN THIN METAL MATERIAL

This is a division of U.S. application Ser. No. 343,280, filed Jan. 27, 1982 now U.S. Pat. No. 4,513,598.

BACKGROUND OF THE INVENTION

The invention relates to apparatus and methods for producing bulges in relatively thin metal material, and more particularly, to apparatus and methods for bulging tubes.

There is a great demand for precision metal tubes having enlarged ring-like portions or collars located near one end, especially in the industries in which high pressure fluid connections are needed. Several prior methods of producing precision bulges in metal tubes are known. One method involves use of die elements having a cylindrical hole into which the portion of the tube to be bulged is extended. A ring-like cavity in the hole defines the desired extent of the bulge. An eccentric mandrel is inserted into the open end of the tube, and the outside of the eccentric mandrel is rotated approximately a dozen times or more, causing outward pressure on the inner wall of the tube so that it gradually expands into the cavity and the die, thereby producing the bulge. This type of machine is sometimes referred to as a "beading machine". It has the shortcoming that it causes thinning of the portion of the tubing in which the bulge is formed. Of course, thinning of the wall of the tubing greatly weakens it (since the thinned material in the bulge is known to have a greatly increased tendency to split or fracture), thereby limiting the depth of the bulge that can be formed.

For approximately the past ten years, I have supplied bulged tubes to the industry by utilizing a machine and process, the details of which I have maintained as a trade secret. This machine utilizes die similar to those described above for the beading achines. A mandrel having a channel therein for conducting high pressure oil is inserted into the open end of the tube when the tube is positioned in the die so that the portion in which the bulge is to be formed is aligned with the ring-shaped bulge cavity in the die. The channel has an opening that is generally aligned with the ring-shaped bulge cavity. First and second O-rings disposed in corresponding grooves around the periphery of the mandrel seal the portion of the mandrel between the two O-rings relative to the die. Oil is then pumped at extremely high pressure through the channel, thereby forcing the portion of the tube to be bulged into the ring-shaped bulge cavity. This has been the most successful known approach to producing bulges having the specifications required by the industry. However, this approach also involves thinning of the portion of the tube in which the bulge is formed, and the depth or height of the bulge is therefore also necessarily limited.

There exists a demand for precision bulged tubes having depths greater than those achievable by the above mentioned beading machines or by means of my earlier machine. Therefore, it is an object of the invention to provide an improved tube bulging apparatus and method.

It is another object of the invention to provide an improved tube bulging apparatus and method that avoids excessive thinning of tube material in the region in which a bulge is formed.

It is another object of the invention to provide a tube bulging machine and method capable of producing high precision bulged tubes having bulge depths greater than has previously been achievable.

It is another object of the invention to provide an apparatus and method for forming a relatively large bulge in a relatively thin piece of metal without causing excessive thinning and weakening of the metal material in which the bulge is formed.

SUMMARY OF THE INVENTION

Briefly described, and in accordance with one embodiment thereof, the invention provides an apparatus and method for forming a bulge in a first portion of a piece of relatively thin metal wherein the first portion of the metal is aligned with a recess or bulge cavity in a die, fluid pressure is uniformly applied to the metal to force the metal to be bulged into the bulge cavity while simultaneously producing forces transverse to the fluid force on the metal to slide it along portions of the die adjacent to the bulge cavity to feed additional portions of the metal into the bulge cavity, allowing the fluid force to continue bulging of the material into the recess without excessive thinning of the metal material where the bulge is being formed.

In one described embodiment of the invention, a tube bulger includes upper and lower mating die sections which, when mated together, form a cylindrical hole extending through the die. An enlarged ring-shaped portion of the wall of the cylindrical hole forms a ring-shaped recess or bulge cavity into which the bulge is formed and defines the extent of the bulge. During operation, the end portion of the tube to be bulged extends into the cylindrical hole. An elongated mandrel extends into an opposite end of the hole and into the open end of the tube. First and second spaced sealing rings are disposed about the mandrel on opposite sides of the ring-shaped bulge cavity and provide a seal between the mandrel and the inner wall of the tube to be bulged. A high pressure oil source forces oil through a channel in the mandrel. The channel opens in the wall of the mandrel between the two sealing rings, so the high pressure oil thereby produces outward force which causes an initial bulging of the tube material into the ring-shaped bulge cavity. An enlarged shoulder of the mandrel abuts the open end of the tube. After the initial bulge has been formed, the mandrel is forced toward the ring-shaped bulge cavity, forcing additional tube material to slide into the ring-shaped bulge cavity. The initially formed portion of the bulge engages the opposite side of the ring-shaped recess to prevent the tube from sliding out of the cylindrical hole. The pressure of the oil in the channel is maintained at a high level while the shoulder of the mandrel is slid toward the ring-shaped bulge cavity, causing the further outward bulging of the tube material because the sliding of additional tube material into the recess allows the additional bulging to occur without significant further thinning (or weakening) of the tube material contained in the final bulge.

In another embodiment of the invention, a bulge is produced in a sheet of relatively thin material which is placed against a die having a bulge cavity therein corresponding to the desired shape of the bulge to be produced. A block is pressed against the face of the sheet opposite to the bulge cavity, and means are provided for producing a high pressure sealing relationship between the block and the sheet of metal around the bulge cavity. An oil conducting channel extends through the block and opens at a surface thereof surrounded by the sealing means. High pressure oil is forced in through the channel against the portion of the surface of the sheet opposed to and aligned with the bulge cavity, thereby producing an initial bulging of the sheet into the bulge cavity. As the high pressure oil is forced against the portion of the sheet in which the bulge is being formed, a mandrel engages a portion of the sheet adjacent to the bulge being formed and forces it to slide along the die toward the bulge cavity, thereby feeding additional sheet material into the recess while the oil pressure is being applied. This allows further bulging of the sheet material into the bulge cavity without significant additional thinning (or weakening) of the bulge being formed.

BRIEF DESCRIPTION OF THE DRAWINGS

FIG. 3 is a partial exploded perspective view of the die shown in FIG. 2A.

FIG. 4 is a section view taken along section line 4—4 of FIG. 3.

FIG. 5 is a section view taken along section line 5—5 of FIG. 3.

FIG. 6 is a section view of an alternate embodiment of the invention for forming a bulge in a sheet of material.

FIG. 7 is a partial perspective view showing a bulge formed by the machine of FIG. 6.

FIG. 8 is a partial section view of an alternate embodiment of the invention.

FIG. 9 is a partial perspective view of a piece of metal showing a bulge formed with the machine of FIG. 8.

DESCRIPTION OF THE INVENTION

Figures 1A, 1B:
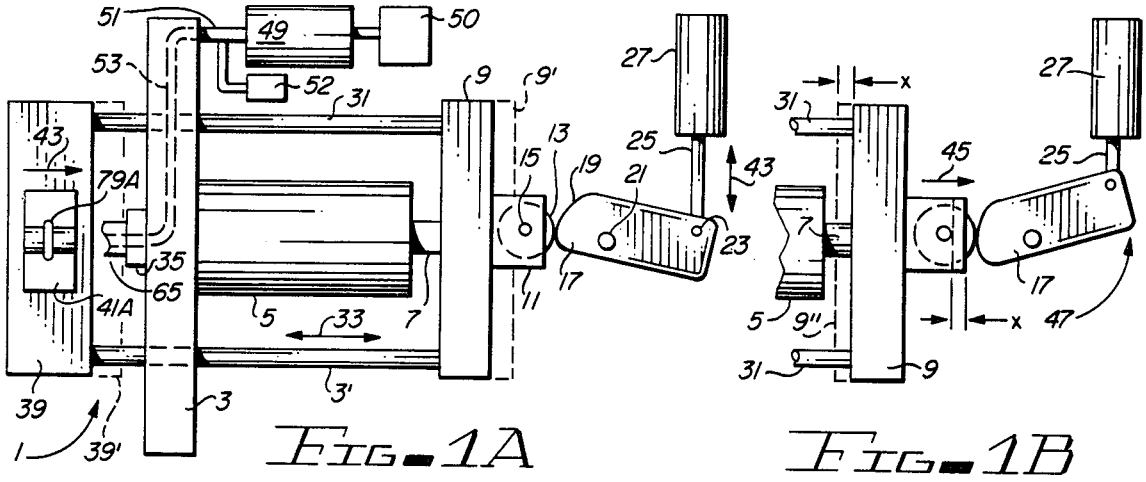
FIG. 1A is a simplified diagram showing a top view of one embodiment of the invention.
FIG. 1B is a diagram of a portion of the top view of FIG. 1A useful in explaining the operation of the devise of FIG. 1A.

Referring now to the drawings, particularly FIGS. 1A through 5, tube bulger 1 performs the function of producing a bulge 77B' (FIG. 2B) in a piece of metal tube 77.

Figure 2A:
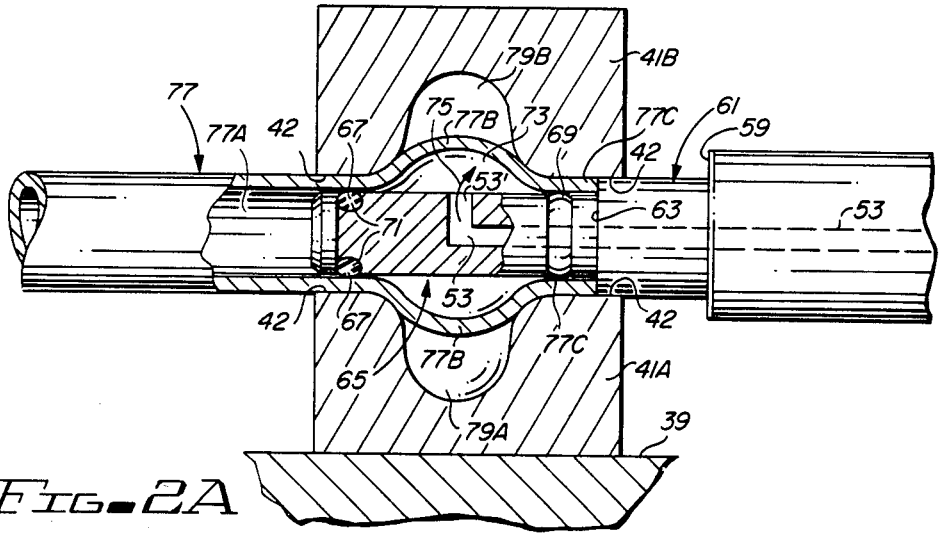
FIG. 2A is a partial cutaway section view of the device of FIG. 1A.

Referring now to FIGS 1A and 2A, the main components of tube bulger 1 include a lower die element 41A, a mating upper die element 41B which can be attached to lower die 41A, a movable support block 39 to which lower die 41A is rigidly attached, a stationary block 3 to which a mandrel 65 is attached, a high pressure pneumatic cylinder 5 having a movable rod 7, a movable block 9 rigidly attached to rod 7, a pair of connecting rails 31 that connect movable block 39 to movable block 9, a roller 13 journalled between two blocks 11 that are attached to movable block 9, and a pivotal cam 17 that controls the position of movable block 9.

As best seen in FIGS. 3, 4 and 5, lower die 41A and upper die 41B fit together such that a cylindrical hole 42 is formed. Cylindrical hole 42 extends through the mated die. An enlarged ring-shaped groove 79A, 79B (see FIG. 2A) forms an enlarged portion of the wall of cylindrical hole 42, thereby forming a bulge cavity into which the bulge 77B' (FIG. 2B) is formed in metal tube 77.

A pair of shallow grooves 93 extend from ring-shaped bulge cavity 79A, 79B along the upper mating surface of lower die 41A. This channel allows any excess oil in bulge cavity 79A, 79B to leak out as bulge 77B' fills up bulge cavity 79A, 79B. Note that in FIG. 1A, upper block 41B is omitted for clarity so that lower portion 79A of the above mentioned bulge cavity 79A, 79B can be seen.

Mandrel 65 includes an elongated cylindrical piece of steel having an outside diameter slightly less than the inside diameter of metal tube 77. An oil-conducting channel 53 extends axially through mandrel 65 and has an opening 53' through the wall of mandrel 65. Opening 53' is located between O-ring seals 67 and 69, which are respectively disposed in a pair of circular grooves such as 71 on opposite sides of bulge cavity 79A, 79B. The sealing rings 67 and 69 provide resistance to leakage of oil forced at high pressure through channel 53 into the region indicated by reference numeral 73 in FIG. 2A as the bulge is being formed.

At this point, it will be convenient to describe the initial phase of the operation of the tube bulger 1. With tube 77 extending into cylindrical hole 42, as indicated in FIG. 2A, oil is pumped at high pressure through channel 53. The oil pressure is sufficiently great that the wall of metal tube 77 begins to expand or "bulge" into recess 79A, 79B. Upper die 41B and lower die 41A are pressed tightly together, clamping the surface of cylindrical hole 42 tightly against the outer surface of metal tube 77. Consequently, the initial bulging caused by the high pressure oil slightly stretches the material of metal tube 77. The amount of stretching is initially very slight, but rapidly increases as the depth of the bulge increases. The oil pressure is maintained at such a level that only an initial amount of bulging insufficient to cause excessive thinning of the metal tube 77 occurs. Those skilled in the art will recognize that the amount of oil pressure required to produce further outward bulging of metal tube 77 would increase substantially as further stretching and thinning of the metal occurs.

In accordance with the present invention, mandrel 65 includes an enlarged portion 61 with a shoulder 63 that extends into the right hand end of cylindrical hole 42. Shoulder 63 abuts the open right end of tube 77.

Figure 2B:
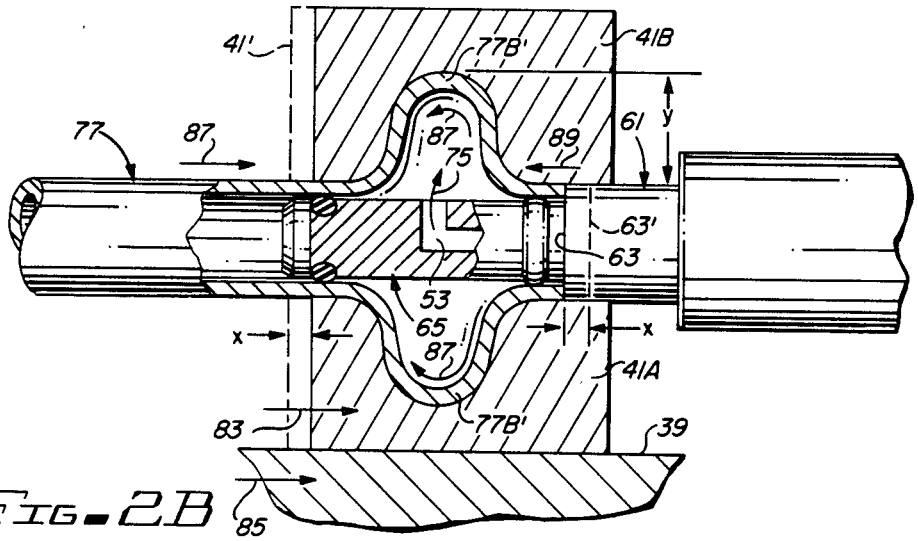
FIG. 2B is a partial cutaway section view similar to that of FIG. 2A showing relative movement of the die and mandrel of FIG. 2A.

As indicated in FIG. 2B, tube bulging machine 1 is operated to cause block 39 to move toward shoulder 63 in the direction indicated by arrow 85. This, of course, causes both lower die 41A and upper die 41B to move to the right by an amount indicated by x. x is the distance between dotted line 41' and the left edges of die sections 41A and 41B, as indicated in FIG. 2B.

Dotted line 63' in FIG. 2B indicates the original position of shoulder 63 relative to the right hand edge of die 41A and 41B. It can be seen that the open end of tube 77 moves the distance x inward toward ring-shaped grooves 79A, 79B. This causes some of the end portion of tube 77 to slide along the wall of cylindrical opening 42 into recess 79A, 79B, as indicated by arrows 87 in FIG. 2B. The oil pressure through channel 53 continues to be maintained at approximately the pressure that produced the initial bulge that is designated by reference numeral 77B in FIG. 2A. This pressure is great enough that as the above mentioned portion of end material of metal tube 77 slides into ring-shaped bulge cavity 79A, 79B, further outward bulging continues to occur until the final bulge 77B' fills up ring-shaped bulge cavity 79A, 79B.

Since fluid pressure has been maintained at a sufficiently low level that additional stretching of metal tube 77 does not occur, it can be seen that the enlarged bulge 77B' has been obtained without any additional significant thinning or weakening of the metal in bulge 77B'.

Although various techniques could be used for producing the relative movement x between mandrel shoulder 63 and die 41A, 41B, the structure shown in FIG. 1A illustrates one technique that has been successfully utilized. As mentioned above, block 3 of FIG. 1A is stationary by virtue of being attached to a stationary support plate, not shown. Cam member 17 is pivotally connected by means of pin 21 to the same stationary support plate. The initial position of block 9, and hence of block 39 and die 41A, 41B, is determined by the initial position of cam element 17. This initial position is shown in FIG. 1A. High pressure cylinder 5 provides sufficient outward force on rod 7 that roller 13 engages the lower portion of camming surface 19, thereby establishing the initial position of die 41A, 41B relative to mandrel shoulder 63. With the metal tube 77 and upper die 41B rigidly in place, one-way high pressure valve 49 is opened to allow oil from high pressure pump 50 to be forced through tube 51 and channel 53 into opening 53' of mandrel 65. Then, pneumatic cylinder 27 is actuated in order to produce the above mentioned movement x. Pneumatic cylinder 27 has a movable rod 25 which is pivotally connected by pin 23 to the left hand end portion of cam element 17. This causes cam element 17 to rotate in the direction indicated by arrow 47 in FIG. 1B. Camming surface 19 is sloped such that roller 13, and hence journaling blocks 11 and also block 9 move to the right through the distance x. In FIG. 1A, dotted lines 9' and 39' represent the final positions of the right hand edges of blocks 9 and 39. The movement of block 39 is translated by means of rails 31 to block 39. Reference numeral 9" in FIG. 1B represents the initial position of the left hand edge of block 9.

After the forming of bulge 77B' has been completed, an oil pressure relief valve 52 is opened to relieve the oil pressure (since ordinarily valve 49 would be a one-way valve). Upper die 41B is removed, and bulged tube 77 can be removed from mandrel 65. As a typical example of the results which I have obtained with the tube bulger machine 1, if 022 wall aluminum tubing having an outside diameter of one-fourth of an inch is used, and the cam element 17 is operated to cause the distance x to be approximately hydraulic pressure of oil forced 55 mils, and the internal hydraulic pressure of oil forced through channel 53 is approximately 12,000 pounds per square inch, a bulge depth 7 (see FIG. 2B) of over 53 mils is formed with no significant thinning or weakening of the metal tube material. By increasing the depth of the ring-shaped bulge cavity 79A, 79B and increasing the distance x, substantially deeper bulges could be obtained without significant weakeneing, if there should prove to be a need for such bulge depths.

This is a very substantial improvement over bulges that can be produced using the previously mentioned prior machines and techniques. Using those prior machines and techniques thinning occurs, approximately 30 mils is the maximum bulge depth that can be attained on the metal tube of the above example.

Those skilled in the art can easily purchase and/or make the various components of tube bulger 1. For example, high pressure pump 50 can be implemented by means of a type of pump known as an air over oil hydraulic pump, which is commercially available from several suppliers, such as SC Hydraulic Engineering Corporation, of Los Angeles, Calif. The other pneumatic cylinders and the various valves described above are readily available from various suppliers.

The basic principle of the invention can be utilized for producing bulges in metal material other than in tubes. For Iexample, bulges can also be provided in flat or curved sheets of material, as can be seen in FIGS. 6–9. For example, in FIG. 6, a flat metal sheet 75 is initially positioned against die 41B', which has a bulge cavity 79 therein. A lower block 58 abuts the lower surface of metal sheet 95 around the bulge cavity 79. A sealing ring 62 fits in a groove 60 that surrounds the bulge cavity 79 and seals the region 73. Oil conducting channel 53' extends from a suitable high pressure oil source, such as 50 in FIG. 1A, through block 58 and opens into region 73. The high pressure oil is pumped into region 73 in the manner previously described, causing an initial bulge by forcing the sheet material upward in the direction indicated by numeral 99. A mandrel 65' engages the right hand edge of sheet 95, forcing it inward in the direction indicated by arrow 103 by an amount x, thereby feeding additional metal material into the bulge cavity 79 in precisely the same manner as previously described. This allows the force produced by the oil pressure in region 73 to continue bulging the sheet material outward in the direction indicated by arrow 105 to produce the completed bulge 95' without further significant stretching or weakening of the metal sheet material. Of course, by providing appropriately curved surfaces on block 58 and die 41B', as indicated in FIG. 8B, a suitably deep bulge 107' can be formed in a curved piece of relatively thin metal material 107.

While the invention has been described with reference to several particular embodiments thereof, those skilled in the art will be able to make various modifications to the disclosed apparatus and method without departing from the true spirit and scope thereof. For example, if metal tube material is simultaneously fed into the bulge recess from opposed sides of the die, there is no need to form an initial bulge with oil pressure only (so that the initial bulge can resist sliding of the entire tube as the mandrel forces the open end of the tube toward the recess).

Although the disclosed bulges have generally semicircular cross sections, obviously the bulges could have generally eliptical or rectangular cross sections. In certain instances, for example, where an expanded diameter end portion is desired in a tube, the bulge could be step-shaped if suitable configurations are provided for the bulge cavity and the mandrel.

I claim:

1. An apparatus for forming a bulge in a first portion of a piece of relatively thin metal, said apparatus comprising in combination:

(a) a die having a cavity therein and a first surface adjacent said cavity;

(b) means for abutting a second portion of said piece of metal against said first surface of said die, said first portion of said piece of metal being adjacent to said second portion of said second piece of metal and being positioned in generally aligned relationship with said cavity;

(c) means for applying a predetermined amount of pressure by means of pressurized fluid on said piece of metal on a surface thereof opposed to said cavity in order to cause an initial bulging of said first portion of said piece of metal into said cavity; and (d) means for applying a transverse force to said piece of metal while said fluid pressure is applied thereto in order to force some of said second portion of said piece of metal to slide into said cavity to allow said fluid pressure to cause further bulging of said piece of metal into said cavity without excessive thinning of said piece of metal, said transverse force being transverse to a force produced on said first portion of said piece of metal by said fluid pressure.

2. The apparatus of claim 1 wherein said piece of metal includes a tube, and wherein said bulge is to be formed as a peripheral ring-shaped enlargement of a portion of said tube adjacent to an end thereof, and wherein said die includes first and second mating die elements which, when mated, form a cylindrical hole, said first surface including a portion of the surface of said cylindrical hole, said recess being bounded by a ring-shaped, outwardly oriented enlargement in the wall of said cylindrical hole, said end of said tube extending into one end of said cylindrical hole, the outer surface of said tube abutting the surface of said cylindrical hole, and means for forcing said first and second die elements together to cause the wall of said cylindrical hole to abut the outer surface of said tube.

3. The apparatus of claim 2 wherein said pressure applying means includes an elongated mandrel means for extending through an opposite end of said cylindrical hole into said end of said tube, said mandrel means including a fluid-conducting channel for conducting pressurized fluid to said first portion of said piece of metal, said mandrel means also including means for sealing portions of said tube on each side of said cavity with respect to said mandrel.

4. The apparatus of claim 3 wherein said sealing means includes first and second O-rings disposed in sealing relationship between said mandrel and said tube on opposite sides of said opening to prevent leakage of said pressurized fluid.

5. The apparatus of claim 4 wherein said pressure applying means includes a high pressure oil pump and a control valve connected in series relationship with said channel and said oil pump for controlling flow of oil from said oil pump into said channel.

6. The apparatus of claim 5 wherein said transverse force applying means includes a shoulder of said mandrel for abutting said end of said tubing and means for causing relative movement between said shoulder and said die to slide said end of said tube toward said cavity while said pressure is maintained in order to cause additional bulging of said tube into said cavity.

7. The apparatus of claim 6 wherein said relative movement causing means includes a first support for said mandrel, a high pressure pneumatic cylinder means engaging said first support, means for connecting said pneumatic cylinder means and said die for effecting changing of the position of one of said die and said mandrel relative to the other.

8. The apparatus of claim 7 including camming means for engaging said connecting means to precisely control the amount of movement of said one of said die and said mandrel relative to the other, said pneumatic cylinder means urging said connecting means against said camming means and causing said connecting means to move in response to movement of a camming surface of said camming means.

* * * * *